US007435160B2

(12) United States Patent
Marrs, III

(10) Patent No.: US 7,435,160 B2
(45) Date of Patent: Oct. 14, 2008

(54) AUTOMATED FLOOR SANDER

(76) Inventor: Glenn L. Marrs, III, 10550 County Road 81, Suite 205, Maple Grove, MN (US) 55369

( * ) Notice: Subject to any disclaimer, the term of this patent is extended or adjusted under 35 U.S.C. 154(b) by 241 days.

(21) Appl. No.: 11/372,264

(22) Filed: Mar. 10, 2006

(65) Prior Publication Data

US 2007/0212982 A1 Sep. 13, 2007

(51) Int. Cl.
*B24B 49/00* (2006.01)

(52) U.S. Cl. ..... 451/11; 451/350; 451/355

(58) Field of Classification Search ..... 451/11, 451/350, 355, 915
See application file for complete search history.

(56) References Cited

U.S. PATENT DOCUMENTS

| | | | |
|---|---|---|---|
| 3,129,539 | A | 4/1964 | Tempero |
| 3,161,994 | A | 12/1964 | Neitzer, Jr. |
| 3,592,071 | A | 7/1971 | Steinke |
| 3,789,552 | A | 2/1974 | Bradbury et al. |
| 3,867,796 | A | 2/1975 | Sonnenberg |
| 3,900,973 | A | 8/1975 | Van Der Linden |
| 4,177,609 | A | 12/1979 | Rameckers et al. |
| 4,492,002 | A | 1/1985 | Waldhauser et al. |
| 4,574,531 | A | 3/1986 | McCurry |
| 4,679,271 | A | 7/1987 | Field et al. |
| 4,768,311 | A | 9/1988 | Olson |
| 4,910,824 | A | 3/1990 | Nagayama et al. |
| 5,056,175 | A | 10/1991 | Stein et al. |
| 5,184,424 | A | 2/1993 | Miller |
| 5,341,605 | A | 8/1994 | Tasikas |
| 5,575,710 | A | 11/1996 | Kramer |
| 5,605,493 | A | 2/1997 | Donatelli et al. |
| 5,643,047 | A | 7/1997 | Beckett et al. |
| 5,698,957 | A | 12/1997 | Sowada |
| D400,073 | S | 10/1998 | Hara |
| 5,940,928 | A | 8/1999 | Erko |

(Continued)

FOREIGN PATENT DOCUMENTS

| | | |
|---|---|---|
| EP | 498411 | 8/1992 |

(Continued)

OTHER PUBLICATIONS

Website, http://www.swadesir.com.au/floor_sanding_machines/kunzle_tasin_index.html, Three Pages Printed May 15, 2005, Series of Floor Sanding Machines.

*Primary Examiner*—Eileen P. Morgan
(74) *Attorney, Agent, or Firm*—Richard C. Litman

(57) ABSTRACT

The automated floor sander includes numerous devices and mechanisms to facilitate the task of the operator of the machine. The machine includes a variable speed drive mechanism, enabling the operator to select the desired travel speed over the surface in order to optimize results. Another feature is the automated sanding drum lifting and lowering mechanism, which automatically raises and lowers the drum if the travel speed of the machine respectively decreases or increases below or above a predetermined point. A manual mechanism for controlling drum height is also provided. Yet another feature is a novel mechanism for automatically centering the sanding belt on its tension roller, which mechanism greatly reduces wear and tear on the belt and friction in the system when the belt reaches one end of the tension roller. These mechanisms may be incorporated separately from one another or in combination in a single machine, as desired.

16 Claims, 14 Drawing Sheets

U.S. PATENT DOCUMENTS

| | | | | |
|---|---|---|---|---|
| 6,155,917 | A | 12/2000 | Tasikas | |
| 6,347,652 | B1 | 2/2002 | Hunter | |
| 6,575,819 | B2 | 6/2003 | Beyersdorff | |
| 6,578,858 | B1 | 6/2003 | Haddock | |
| D502,072 | S | 2/2005 | Wright | |
| 6,986,397 | B2 * | 1/2006 | Mattson et al. | 180/11 |
| 2001/0014577 | A1 * | 8/2001 | Frech et al. | 451/355 |
| 2005/0065662 | A1 | 3/2005 | Reindle et al. | |

FOREIGN PATENT DOCUMENTS

| | | |
|---|---|---|
| WO | WO92/02334 | 2/1992 |

* cited by examiner

AUTOMATED FLOOR SANDER

BACKGROUND OF THE INVENTION

1. Field of the Invention

The present invention relates generally to powered machines adapted for refinishing floors and similar surfaces. More particularly, the present invention comprises an automated, self propelled drum-type floor sander or refinisher incorporating a variable speed drive, a mechanism for raising and lowering the drum by control of the operator or automatically according to the speed of the machine, and a novel sanding belt centering mechanism. The above features may be incorporated singly or in combination in a floor sanding or refinishing machine, as desired. While the various embodiments of the present invention are directed primarily to a drum type powered sanding machine for use on floors, it will be seen that it is not limited to such use, but may be incorporated in various types of walk behind or ride behind floor or surface refinishing and treatment mechanisms, as desired.

2. Description of the Related Art

A large number of powered floor sanders and polishers have been developed over the years, in order to facilitate such work. These powered devices universally include either a drum or a disc powered by an electric motor or other prime mover, and some form of controls for an operator of the machine. Many such devices are sufficiently large as to provide seating for the operator, either integrally with the sanding or refinishing mechanism or as ride behind mechanism with controls.

One problem with such powered devices is that they are prone to damaging the floor if the movement of the machine is not maintained uniformly and consistently over the surface. If the machine progresses too slowly, the sanding drum or disc will remove too much material in that area, resulting in a low spot in the floor. Various mechanisms have been developed to allow the operator to lift the drum, or at least to reduce its pressure on the underlying surface, but the operator must be sufficiently skilled so as to control the machine precisely to avoid gouging the floor with such manually controlled mechanisms.

Another problem with conventional machines is the lack of speed control for the machine. While many powered machines are known which provide propulsion of the machine in addition to power for the sanding drum, such machines generally do not facilitate ready control of the machine's travel speed over the surface, and may have only a single forward speed, a single reverse speed, and/or a neutral or off configuration. This can lead to the same problem noted above, i.e. excessive sanding of the surface in one spot or area due to the machine being stopped or traveling too slowly, or conversely, too rapid a speed over an area which requires additional work.

Yet another problem with conventional machines is the difficulty in keeping the sanding belt centered upon the drum. While various mechanisms are known, they generally rely upon auxiliary rollers near the opposite ends of an idler roller, but misalignment of the belt will often overpower this system.

Thus, an automated floor sander solving the aforementioned problems is desired.

SUMMARY OF THE INVENTION

The automated floor sander incorporates a number of features adapted to facilitate the task of removing the old finish from a flooring surface. The various features or embodiments of the present invention may be incorporated in either walk behind type machines or larger ride on or ride behind machines, as desired.

One of the features of the present automated floor sander is its speed control mechanism which allows the operator to vary the travel speed of the machine over the surface, according to the need to spend more or less time in a given area of the floor.

The present machine may also incorporate a fully automated drum lifting and lowering control system which automatically raises the drum if the speed of the machine decreases below a predetermined point and which automatically lowers the drum if the speed of the machine increases beyond the predetermined point. The machine may also include a manually actuated mechanism for raising and lowering the drum, as desired. In addition to the above mechanisms, the present machine may also include a novel mechanism for automatically centering the sanding belt.

The relatively large and heavy sanding drum drive motor of the present machine may also be quickly and easily removed and reinstalled as desired, without need for specialized tools. This enables the motor and the remainder of the chassis and mechanism to be broken down for carriage up a flight of stairs, ladder, etc., without undue strain upon those persons carrying the device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an automated floor sander incorporating one or more of a series of features therewith. The floor sander may include a variable speed drive, a mechanism for raising and lowering the drum by control of the operator or automatically according to the speed of the machine, and/or a novel sanding belt centering mechanism. The various features may be incorporated in a walk behind type floor sander, or in ride-on floor sanders or floor sanders having ride-behind attachments.

Figure 1:
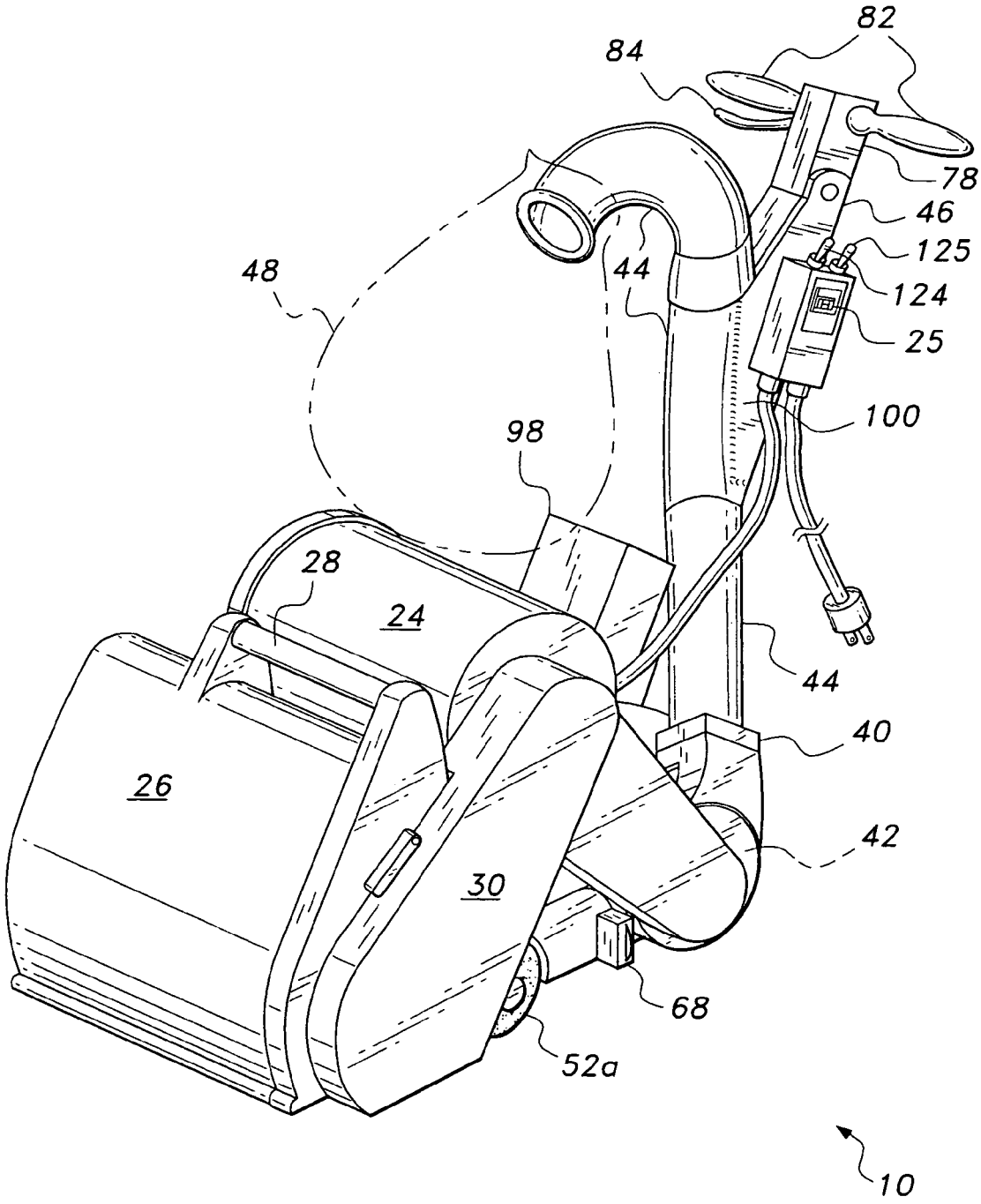
FIG. 1 is a left front perspective view of an automated floor sander according to the present invention, showing its general configuration.
Figure 2:
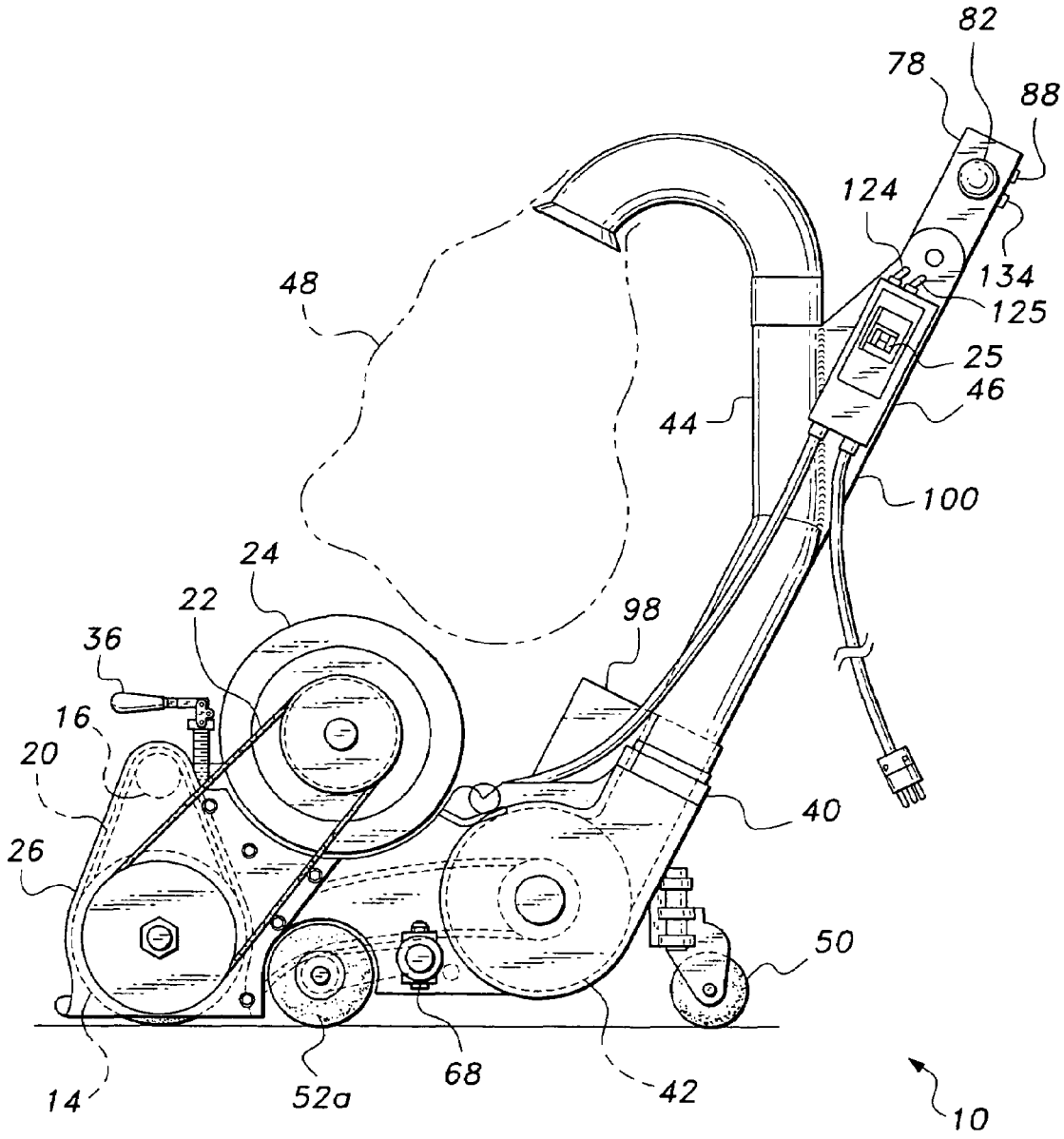
FIG. 2 is a left side elevation view in partial section, showing further details thereof.
Figure 3:
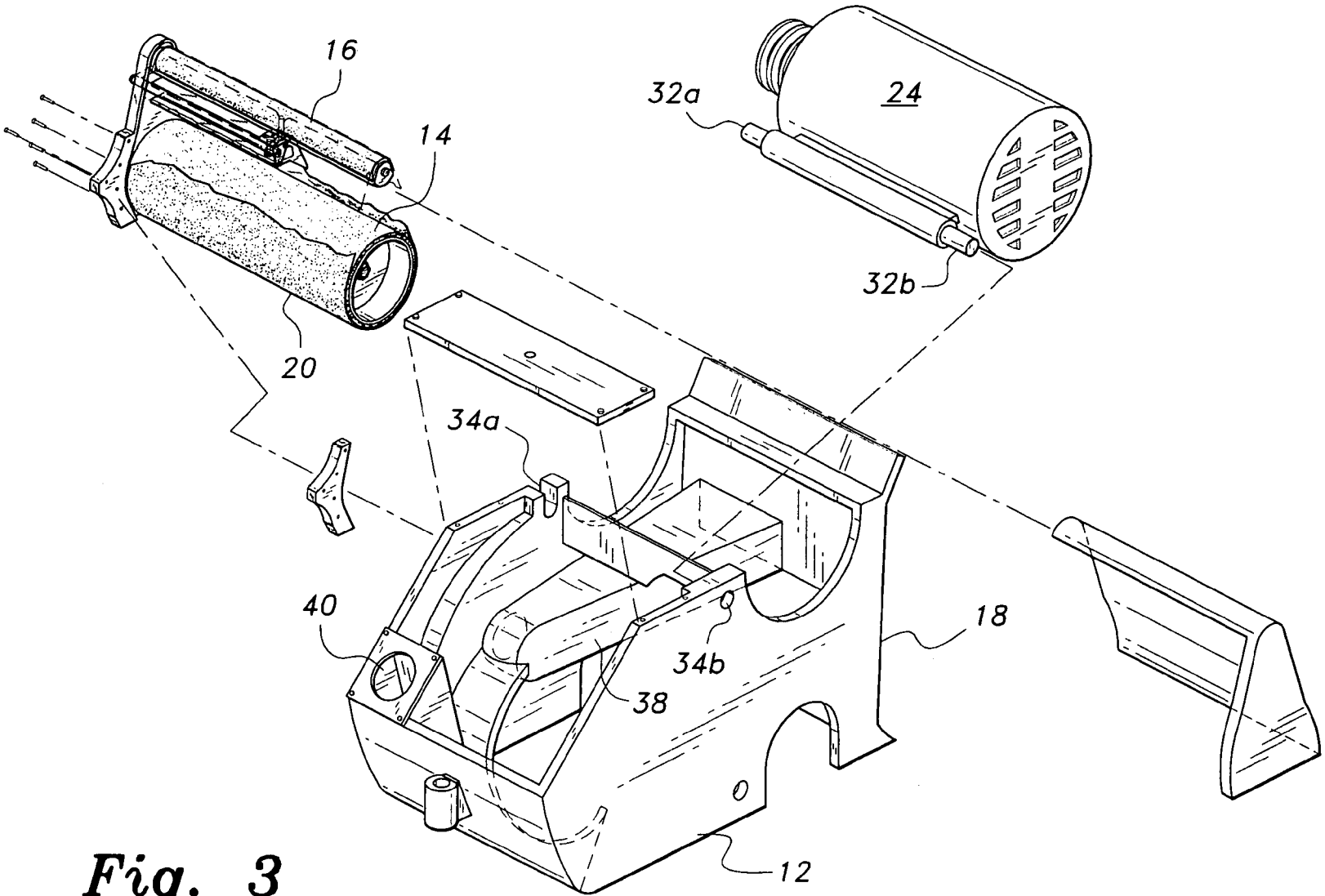
FIG. 3 is an exploded right rear perspective view of the chassis and sanding drum motor assembly of the device, showing details of the motor installation.
Figure 4:
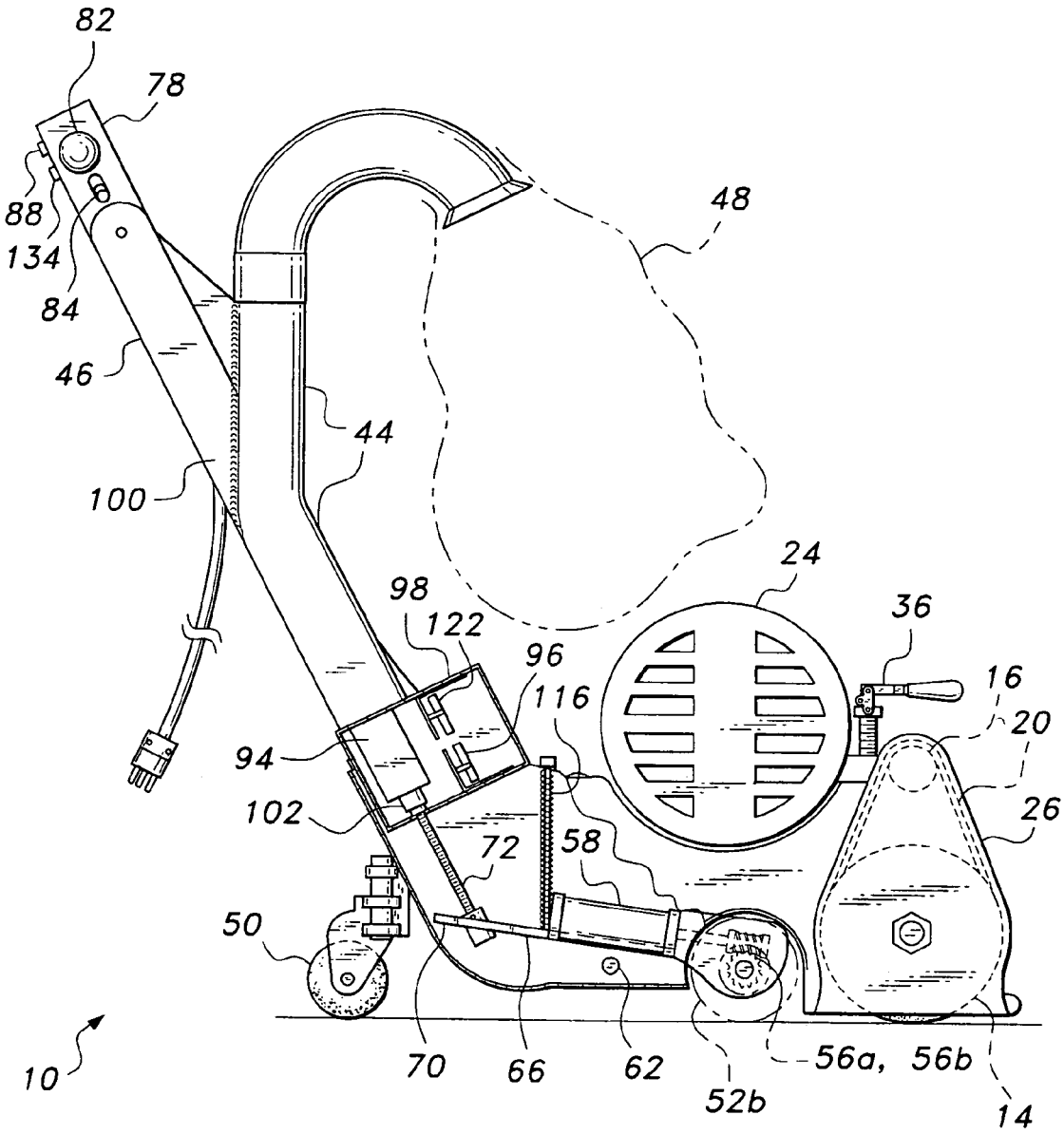
FIG. 4 is a right side elevation view in partial section, showing details of the drive wheel propulsion and wheel and axle assembly height adjustment mechanism.

FIG. 1 provides a left front perspective view of an exemplary walk behind type floor sander 10 incorporating the various features of the present invention, with FIGS. 2 and 4 respectively providing left and right side views and FIG. 3 illustrating the basic chassis of the device. The floor sander 10 includes a chassis 12, which may be cast, welded up, or otherwise formed, preferably of aluminum or other relatively lightweight but durable metal material. The chassis 12 provides for the installation of a rotary, cylindrical sanding drum 14 and sanding belt tension roller 16 laterally across the forward end 18 thereof, with an endless sanding belt 20 extending about the sanding drum 14 and tension roller 16. The sanding drum 14 is driven by a belt 22 (FIG. 2), with the belt 22 in turn being driven by a laterally disposed sanding drum drive motor 24 removably mounted in the upper center of the chassis 12. A front cover 26, which may include a handle 28, and side cover(s) 30 serving to guard the belt 22 and other components, are shown clearly in FIG. 1.

The sanding drum drive motor 24 is a relatively heavy and bulky component, which when combined with the rest of the floor sander 10 apparatus, results in a heavy and cumbersome piece of equipment. This is necessary in order to provide the weight on the forwardly disposed sanding drum for good abrasive action during operation, but results in the assembled device being very difficult to transport manually. Accordingly, the chassis 12 is configured for quick release of the drum drive motor 24 therefrom, as shown in FIGS. 2 and 3. The drum drive motor 24 includes laterally opposed pins 32*a*, 32*b* extending therefrom, which respectively engage a mating slot 34*a* and passage 34*b* in the chassis 12. The passage 34*b* includes oblong entrance and exit sides, resulting in the passage being sloped upwardly from the outer surface to the opposite inner surface of the chassis wall through which it passes. This allows the motor securing pin 32*b* to be inserted into and removed from the passage 34*b* at an angle, with the opposite pin 32*a* lifting essentially straight upward from the slot 34*a* when removal of the motor 24 is desired. A quick release, over center latch 36, or alternatively some other securing means (threaded bolt, etc.) wedges the motor 24 upwardly, with the resulting tension on the sanding drum drive belt 22 securing the motor 24 in place against the pressure of the latch 36. When manual transport of the sander assembly 10 is required, e.g. up a flight of stairs or the like, the heavy motor 24 may be removed from the chassis 12 by releasing the quick release latch 36, disconnecting the electrical connection, removing the loosened sanding drum drive belt 22 from the motor pulley, and lifting the motor 24 from its installed position in the chassis 12. This permits the motor 24 and chassis 12 to be carried independently of one another, thereby greatly reducing the work required to transport the device manually. The motor 24 is quickly and easily installed in the chassis 12 by reversing the procedure described above, to ready the sander for use.

The chassis 12 further includes an internal duct 38, which draws sanding dust from the drum 14 at the forward end 18 of the chassis to a chassis outlet 40 by means of a blower or fan 42 (shown in broken lines in FIGS. 1 and 2). The outlet 40 is connected to a generally upwardly extending duct 44 which also serves as a support or attachment for the handle assembly 46, generally as shown in FIGS. 1, 2, and 4. The duct 44 is angled from the chassis outlet 40 at the left rear of the chassis 12 toward the rear center of the chassis and has a downwardly curving distal end, from which a removable dust collection bag or container 48 depends.

Figure 5:
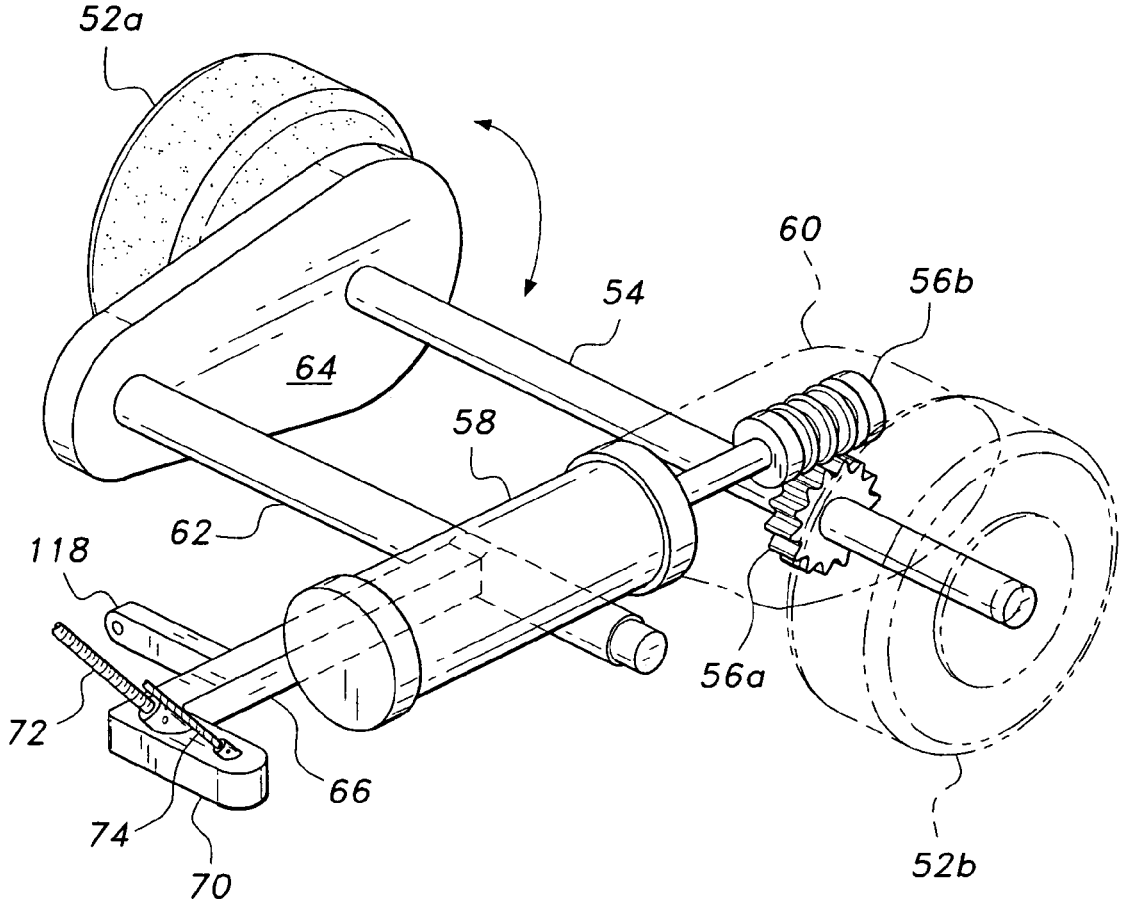
FIG. 5 is a detailed perspective view of the wheel drive motor and axle assembly, showing its articulation for raising and lowering the wheels on the floor to lower and lift the sanding drum accordingly.

The sander 10 is supported by a rearwardly disposed castering wheel 50 and left and right side support and drive wheels 52*a* and 52*b*. The support and drive wheels 52*a* and 52*b* are disposed upon opposite ends of a laterally disposed axle 54 and support the majority of the weight of the sander 10, along with the sanding drum 14. FIG. 5 illustrates the basic support and drive wheel and axle assembly, comprising wheels 52*a*, 52*b* and axle 54. The axle 54 includes a driven worm gear 56*a* which is driven by a drive worm gear 56*b*, with the drive worm gear 56*b* in turn driven by a propulsion motor 58. The gear assembly 56*a*, 56*b* is encased within a case or housing 60 (shown in broken lines in FIG. 5) which affixes the motor 58 immovably to the axle 54 (excepting rotation of the axle). The two drive wheels 52*a*, 52*b* preferably include one-way clutches (not shown) within their hubs, in order to provide a differential effect when turning the machine 10. It should be noted that the propulsion motor 58 drives the axle 54 and wheels 52*a*, 52*b* in a direction opposite the rotation of the sanding drum 14. This is because the drum 14 provides sufficient friction and traction to propel the machine 10 over the underlying surface, with the motor 58, axle 54, and wheels 52*a*, 52*b* acting as a brake to prevent excessively rapid travel across the surface.

The propulsion motor 58 is also immovably affixed to an axle and propulsion motor support shaft 62, which extends laterally across the chassis 12. The opposite ends of the support shaft 62 are pivotally secured within the chassis 12. The propulsion motor 58 is laterally offset toward one end or side of the pivoting support shaft 62, with the opposite end of the support shaft being immovably affixed to an axle carrier 64 which in turn supports the end of the axle 54 adjacent the left side wheel. An axle and propulsion motor support arm 66 extends rearwardly from the propulsion motor 58 and its support shaft 62, and is immovably affixed to those components. Thus, the entire support and drive axle and wheel assembly, comprising the two wheels 52*a*, 52*b*; the axle 54; the propulsion motor 58; the pivot shaft 62; the axle carrier 64; and the support arm 66, form a rigid assembly which pivots arcuately about the lateral axis defined by the pivot shaft 62. As the rearward end of the support arm 66 is raised and lowered (by mechanisms described below), the two drive wheels 52*a*, 52*b* are lowered and raised accordingly, thereby lifting and lowering the sanding drum 14 relative to the underlying surface. Lateral adjustment for leveling the sanding drum 14 relative to the underlying surface is provided by a drive wheel leveling mechanism 68, the left end of which may be seen in FIGS. 1 and 2. Briefly, a threaded bolt passes through the left end of the axle and motor support shaft 62, to adjustably raise or lower that end of the shaft 62 as required.

The relative height of the drive wheels 52*a*, 52*b* may be adjusted either manually by a mechanical linkage, or electrically by means of a manually controlled switch or mechanism, or an automatic system. The rearward actuation end 70 of the axle and motor support arm 66 includes attachments for a manually actuated mechanical link 72 and an electric motor driven link 74.

Figure 7A:
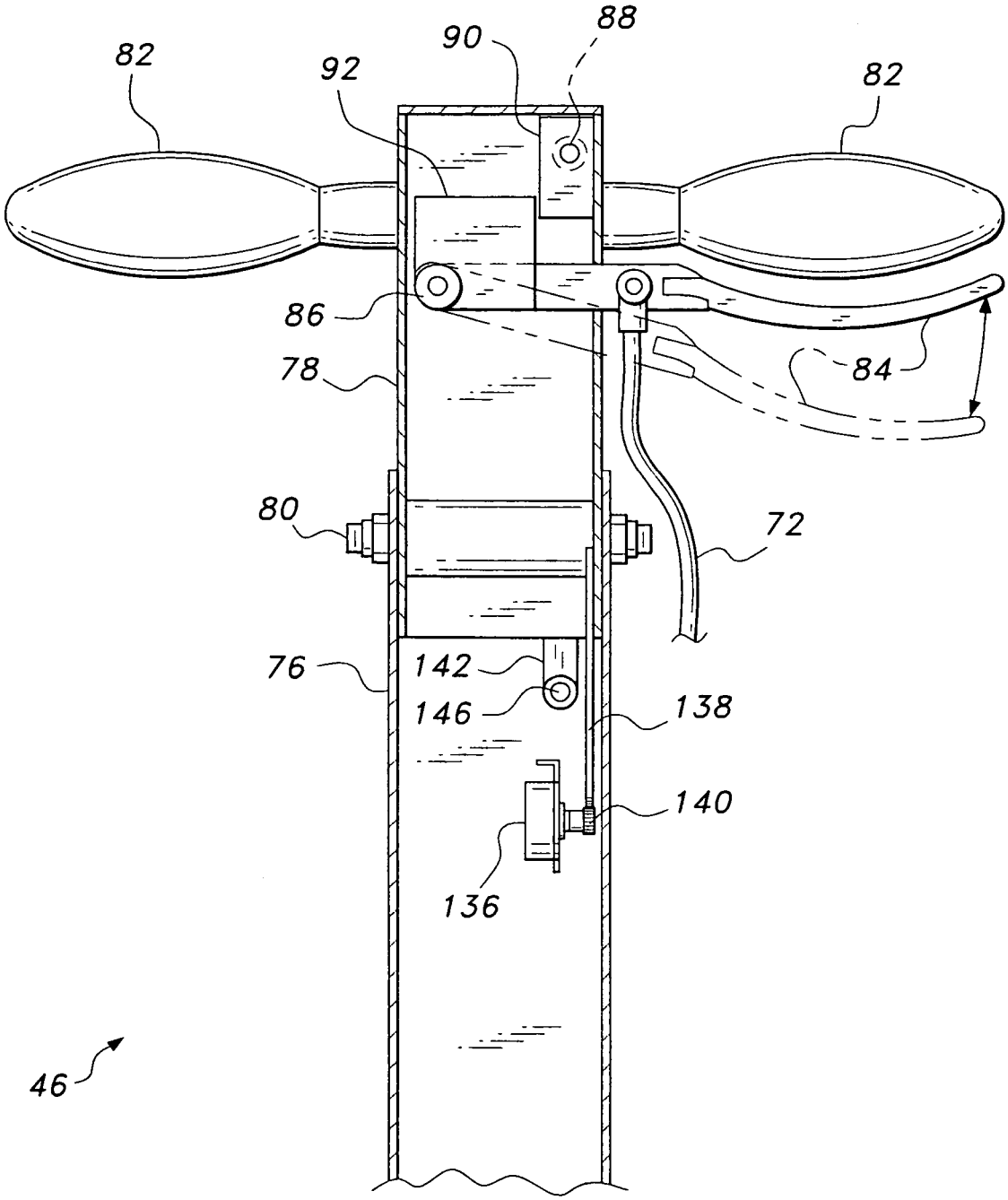
FIG. 7A is a rear elevation view in section of the control handle of the device, showing various details thereof.

The control for the manually operated mechanical link 72 is illustrated in FIG. 7A. The distal, upper operator control end 76 of the handle assembly 46 has an articulated handle extension 78 extending therefrom, pivoting on a lateral pivot 80 passing through the operator control end 76 of the handle assembly. A pair of opposed, relatively fixed hand grips 82 extends laterally from the handle extension 78, with a manual drive wheel positioning lever 84 also extending laterally from the handle extension 78, adjacent one of the fixed hand grips 82. This lever 84 is secured to a pivot 86 within the handle extension 78, with the upper end of the manual link 72 being pivotally attached to the lever 84. The lever 84 may be moved manually to its raised position, shown in solid lines in FIG. 7A, during operation of the machine. This raises the rearward actuation end of the axle and motor support lever arm 66, as shown in FIG. 5, thereby pivoting the motor, axle, and drive wheel assembly about the lateral support shaft 62 and causing the axle 54 and drive wheels 52*a*, 52*b* to lower further, thereby lifting the sanding drum 14 clear of the underlying surface. The lever 84 may be unlatched from its raised position by releasing a rearwardly disposed latch button 88 to move a spring loaded catch 90 forwardly out of the plane of a tang 92 attached to the lever 84, thereby allowing the lever 84 to drop to its lowered position (shown in broken lines in FIG. 7A).

Figure 6:
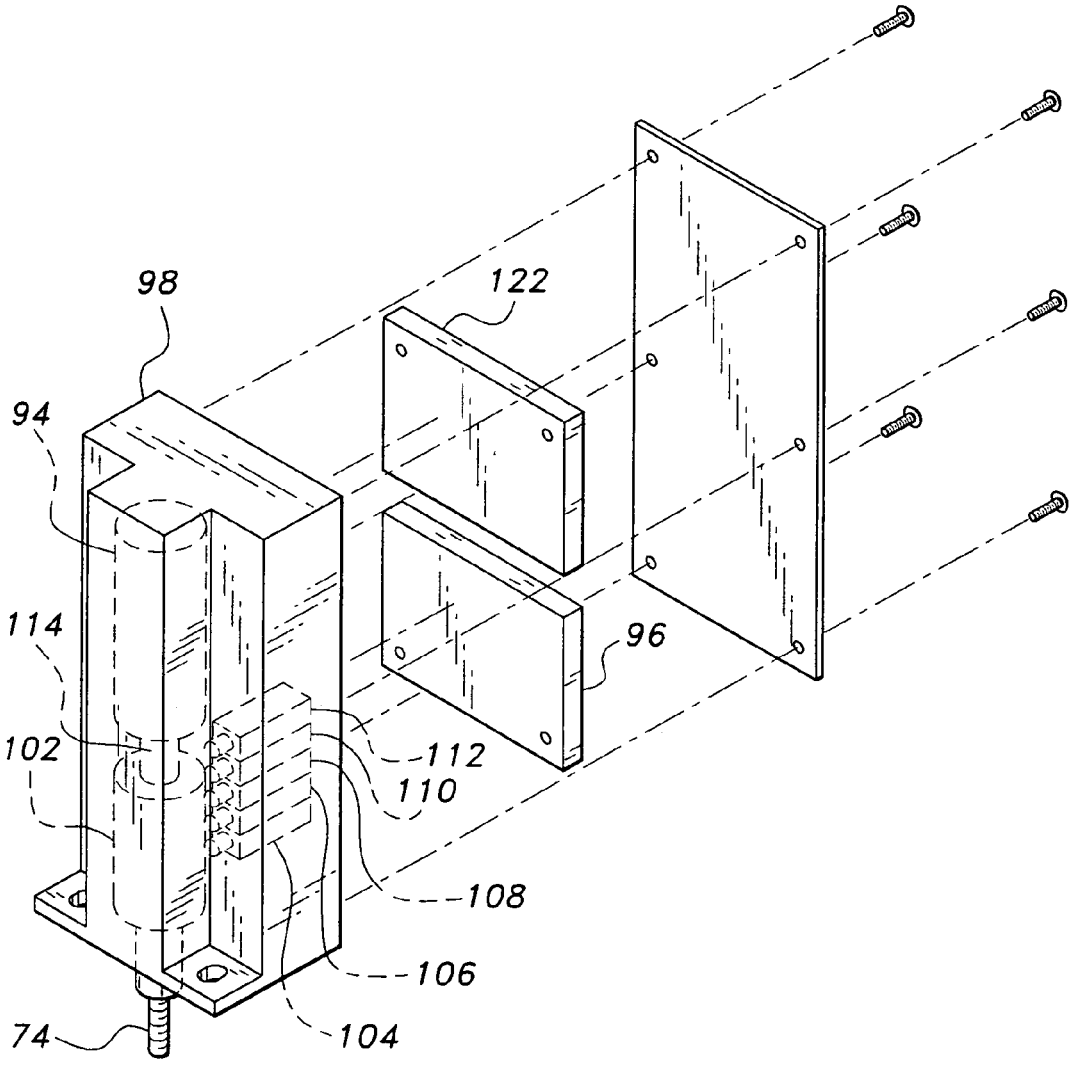
FIG. 6 is an exploded perspective view of the linear actuator motor controlling the lifting and lowering of the drive wheels.

The wheel assembly shown in FIG. 5 may also be adjusted upwardly and downwardly by means of an electrically powered system, if so desired. A drive wheel lifting and lowering motor 94 and circuit boards 96 and 122 for the two motors 58 and 94 are installed in a housing 98 on the chassis 10, adjacent the lower chassis attachment end 100 of the handle assembly 46. (The lower end 100 of the handle assembly 46 is actually welded to the lower portion of the dust collector tube 44, which is in turn rigidly secured to the chassis 10.) The drive wheel lifting and lowering motor 94 is shown in FIGS. 4 and 6, with FIG. 6 providing the greatest detail of the motor 94, electronic control circuit boards 96, the linear actuator 102 driven by the motor 94, and the series of switches 104 through 112 actuated by the linear actuator.

The motor 94 rotates a threaded shaft 114, which passes through the linear actuator 102. The actuator 102 is restricted from rotation by a conventional keyed element, and thus is restricted to linear travel along the threaded shaft 114 as the motor 94 rotates one way or the other. As the actuator 102 travels along the shaft 114, it also moves the link 74 to the drive wheel axle and motor support arm 66, thus adjusting the drive wheels 52*a*, 52*b* upwardly or downwardly and correspondingly adjusting the sanding drum 14 downwardly or upwardly. In practice, the link 74 (and the mechanical link 72) are in tension, as the weight of the machine on the wheels tends to push the wheels upwardly, thereby drawing the actuation end 70 of the arm 66 downwardly. A supplementary tension spring 116 (FIG. 4) attaches to the lateral extension 118 (FIG. 5) of the support arm 66. This spring 116 applies an upward force to the actuation end 70 of the axle and motor support arm 66, thereby urging the wheels 52*a*, 52*b* downwardly to engage the underlying surface to provide traction when both the manual and powered or automated wheel lifting and lowering systems are lowered to allow the wheels to raise and the sanding drum 14 to lower. The tension of the spring 116 is adjustable to adjust the tractive force provided by the wheels accordingly.

Figure 8A:
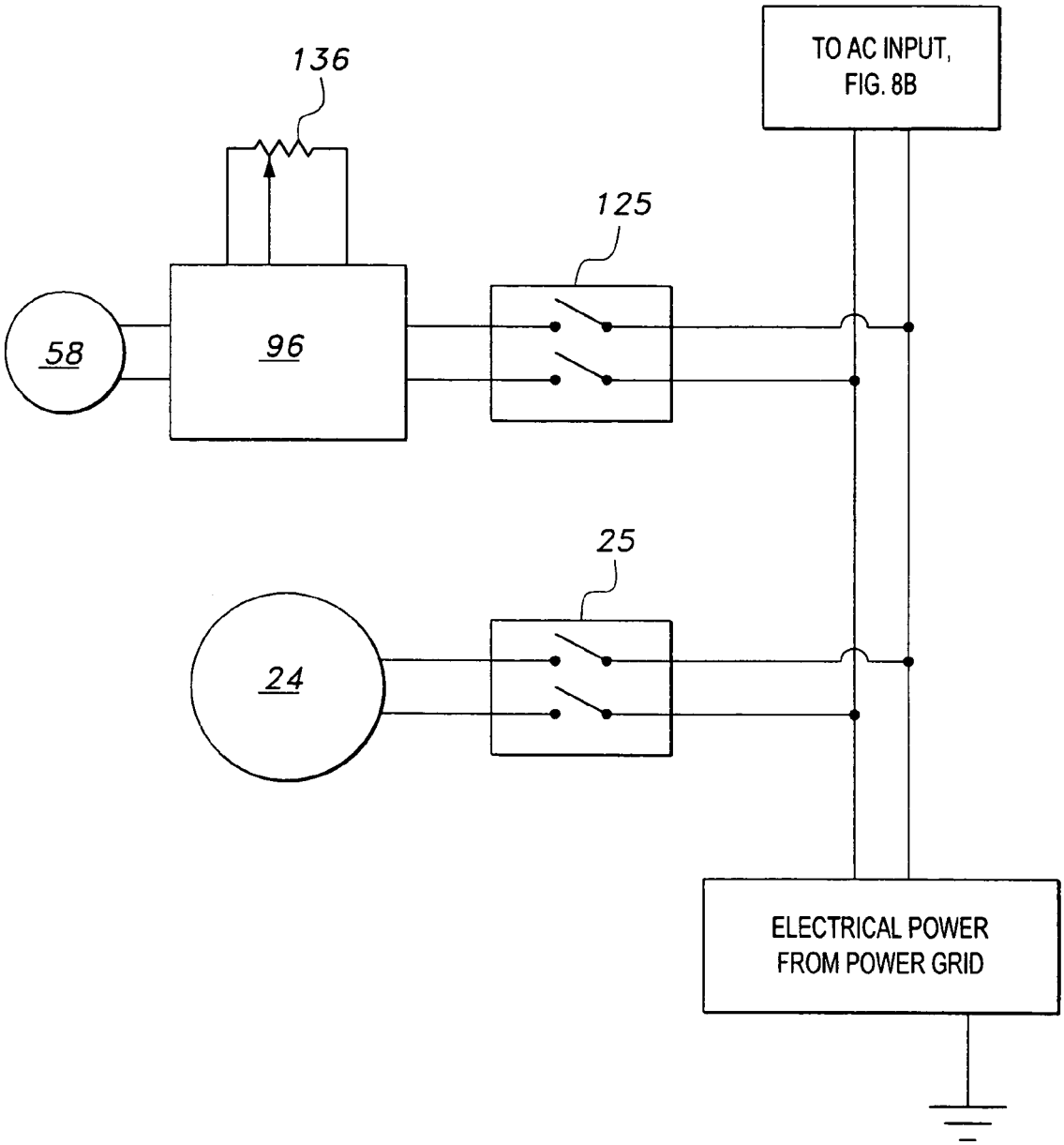
FIG. 8A is an electrical schematic drawing of the circuitry for operating the sanding drum drive motor and propulsion motor of the present machine.
Figure 8B:
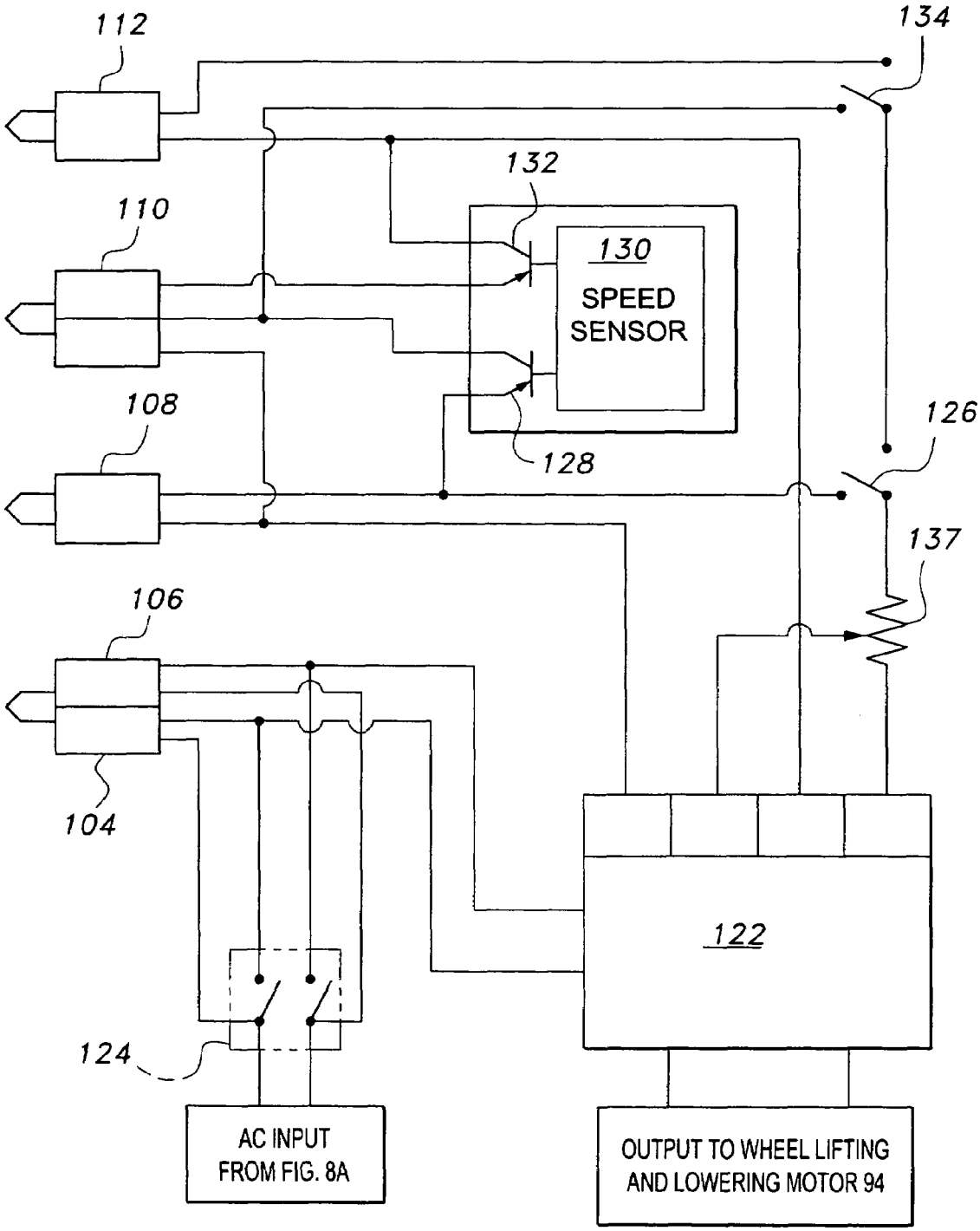
FIG. 8B is an electrical schematic drawing of the drive wheel lifting and lowering systems.

The basic electrical operating system for the present machine is shown in FIGS. 8A and 8B, with FIG. 8A illustrating the basic circuitry from the electrical connection (conventional plug, etc.) to the electrical power grid to the sanding drum drive motor 24 and propulsion motor 58. The drum motor 24 is controlled by a double pole, double toggle switch 25, with the propulsion motor being controlled by the second switch 125 adjacent to the master switch 124. These switches are also shown on the side of the control box on the handle 46 in FIGS. 1 and 2. Electrical power continues from the circuitry of FIG. 8A to provide electrical power to the double pole, double throw master switch 124 shown in schematic of FIG. 8B, and thence to the wheel lifting and lowering system and drive wheel control system shown generally in FIG. 8B.

Figure 9A:
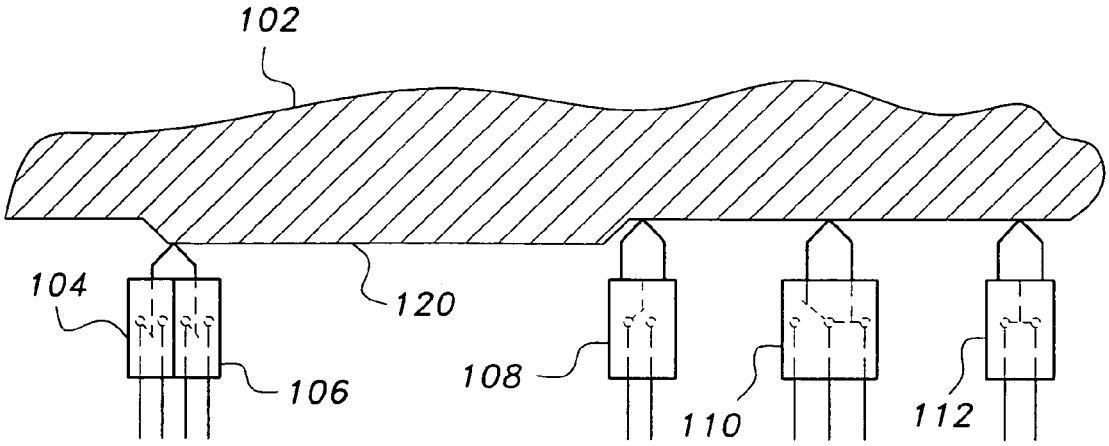
FIG. 9A is a schematic view of the switch configuration when the drive wheels are in their lifted position, i.e. with the sanding drum lowered.
Figure 9B:
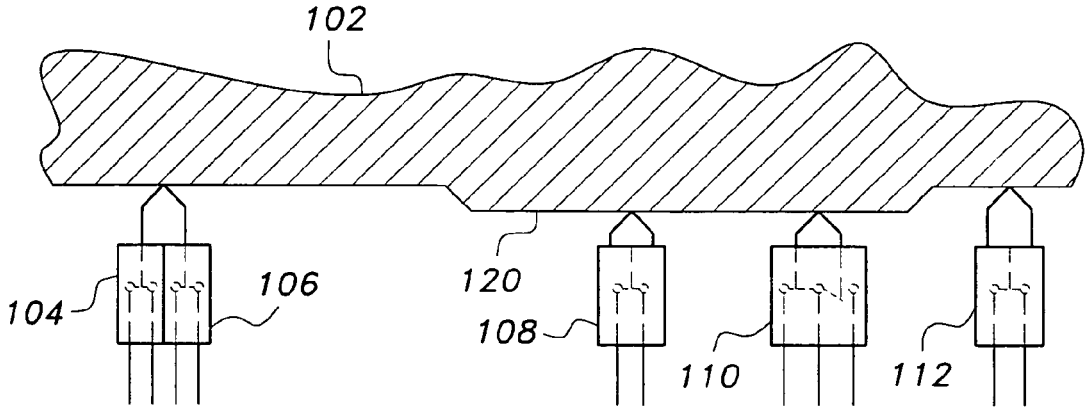
FIG. 9B is a schematic view of the switch configuration when the drive wheels are in a neutral or central position, between their lifted and lowered positions.
Figure 9C:
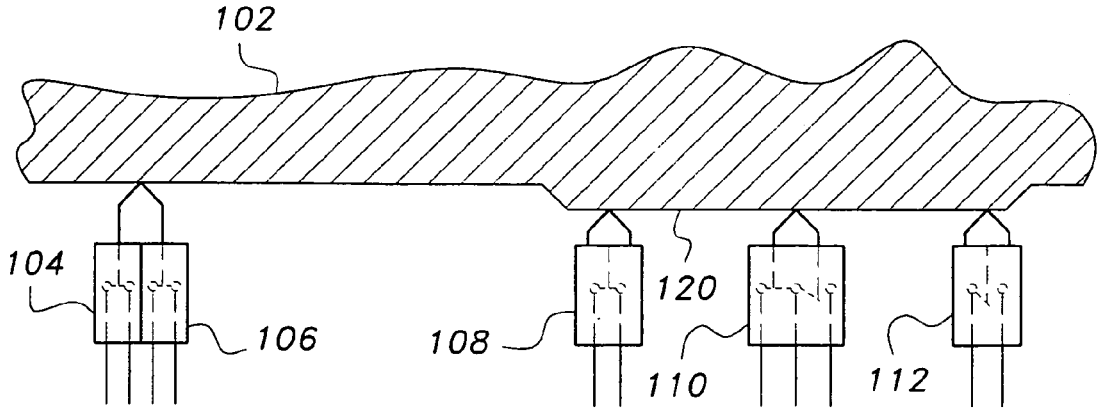
FIG. 9C is a schematic view of the switch configuration when the drive wheels are in their lowermost position, i.e. for lifting the sanding drum clear of the surface.

FIGS. 9A through 9C illustrate the operation of the linear actuator 102. The linear actuator includes a shoulder 120, which moves along the pin plungers of the switches 104 through 112 as the actuator 102 is moved by the drive wheel lifting and lowering motor 94 to open and close those switches.

The first switches 104 and 106, i.e. the leftmost two switches in FIGS. 9A through 9C and the lowermost two switches in FIG. 6, comprise the normally closed power switches which control electrical power to the actuator motor 94. These two switches 104 and 106 may be in the form of one double pole switch having a single contact post, as shown, or two closely adjacent switches. A double pole switch is preferred, as the two switches 104 and 106 preferably act simultaneously to shut off and actuate power to the conventional DC motor control board 122 (FIG. 8B), and hence to the drive wheel lifting and lowering motor 94, which also drives the linear actuator 102. An on-off master toggle switch 124 is also provided on the control box installed on the handle 46. This switch 124 is shown in FIGS. 1 and 2, and in the electrical schematic of FIG. 8B. When the master switch 124 is closed, electrical power is provided to the double pole normally closed switch(es) 104 and 106. Power is supplied from switch (es) 104 and 106 to the control board 122 to power the drive wheel and linear actuator motor 94 as required.

The third switch 108 is normally open, and is closed as the shoulder 120 rides over the pin plunger of the switch. This switch 108 controls power between the circuit board 122 and the high speed switching transistor 128 of the speed sensor 130. The speed sensor 130 is a device which senses the travel speed of the machine 10 over the underlying surface, and automatically raises or lowers the drive wheels 52*a* and 52*b* by means of the linear actuator and wheel lifting and lowering motor 94 when the system is actuated. Speed sensing may be accomplished in various conventional ways, e.g. by sensing the electrical power drawn by the propulsion motor 58, by a tachometer, by an optical encoder, etc. The manual drum latch switch 126 is located with the drum latch handle or manual wheel position lever 84 and latch assembly 86 through 90 of FIG. 7A, although it is shown only in the electrical schematic of FIG. 8B.

When the latch handle or lever 84 is lowered, The drum latch switch 126 is moved to complete the circuit to the momentary on contact switch 134 (see below) and thence to the common line of the third contact switch 110 when the contact switch 134 is actuated, thus allowing the drive wheels 52*a*, 52*b* to rise and allowing the sanding drum 14 to drop to the underlying surface (assuming adequate travel speed of the machine). In this configuration, wheel height control is accomplished by means of the previously noted high speed switching transistor 128 and its counterpart low speed switching transistor 132, via the third through fifth linear actuator contact switches 108 through 112.

When the latch handle or lever 84 is raised to lower the drive wheels 52*a*, 52*b*, the drum latch switch 126 is switched to open the third contact switch circuit and close a circuit to a handle mounted pushbutton or momentary on toggle switch 134. This switch 134 lowers the wheels 52*a*, 52*b*, thus raising the sanding drum 14, when it is pushed to close the circuit between the drum latch switch 126 and the fifth contact switch 112. The pushbutton or toggle switch 134 normally closes the circuit between the drum latch switch 126 and the center pole of the fourth contact switch 110, thus permitting automatic operation of the wheel and sanding drum height by means of the high and low speed switching transistors 128 and 132 of the speed sensor unit 130.

As noted above, the present machine 10 includes circuitry which automatically raises and lowers the sanding drum 14 depending upon the travel speed of the machine over the underlying surface. This is accomplished by means of the speed sensor 130 and the low and high speed switching transistors 128 and 132. When the machine is operating normally, the manual latch handle or wheel position lever 84 is lowered and the toggle or pushbutton switch 134 is released, thus closing the circuit between the third switch 110 and the linear actuator and motor controller 122 to the wheel lifting and lowering motor 94. However, current draw is sensed by the high and low speed switching transistors 128 and 132 by means of the speed sensor 130, with these transistors automatically opening and closing the circuits to the third through fifth switches 108 through 112 and thence to the motor controller 122 to control the linear actuator and wheel height control motor 94. The speeds at which these switching transistors 128 and 132 are actuated may be adjusted as desired.

If the speed reaches too low a point, thus allowing the sanding drum to remain in one spot for too long a period, the low speed switching transistor 132 closes the circuit between the upper pole of the fourth switch 110 and the lower pole of the fifth switch 112, thus actuating the motor 94 to drive the linear actuator from the lowered position shown in FIG. 9A to the center or neutral actuator position shown in FIG. 9B, i.e. lowering the drive wheels 52*a*, 52*b* to raise the sanding drum 14.

When the drive wheels have allowed the travel speed of the machine 10 to increase to a suitable point, the high speed switching transistor 128 senses this from the speed sensor 130 and closes the circuit between the third switch 108 and the center pole of the fourth switch 110. This results in the linear actuator and wheel height position motor 94 moving the linear actuator 102 from the position shown in FIG. 9B back to the position shown in FIG. 9A, thus raising the wheels 52*a*, 52*b* to lower the sanding drum 14 to the underlying surface. The above is accomplished completely automatically, so long as the master switch 124 is on, the drum latch handle or lever 84 is lowered to position the switch 126 properly, and the toggle or pushbutton switch 134 is released in order to close the appropriate portion of the circuit.

It will be realized that the above described mechanical linear actuator and switch series is but one means of accomplishing the switching functions for operating the wheel lifting and lowering mechanism. Other means may be used as well, while still remaining within the bounds of the present invention. For example, an optical system could be provided, with a series of optical detectors detecting the position of the linear actuator and operating the system accordingly. Infrared or magnetic means for detecting the position of the actuator could also be provided, if so desired.

Figure 7B:
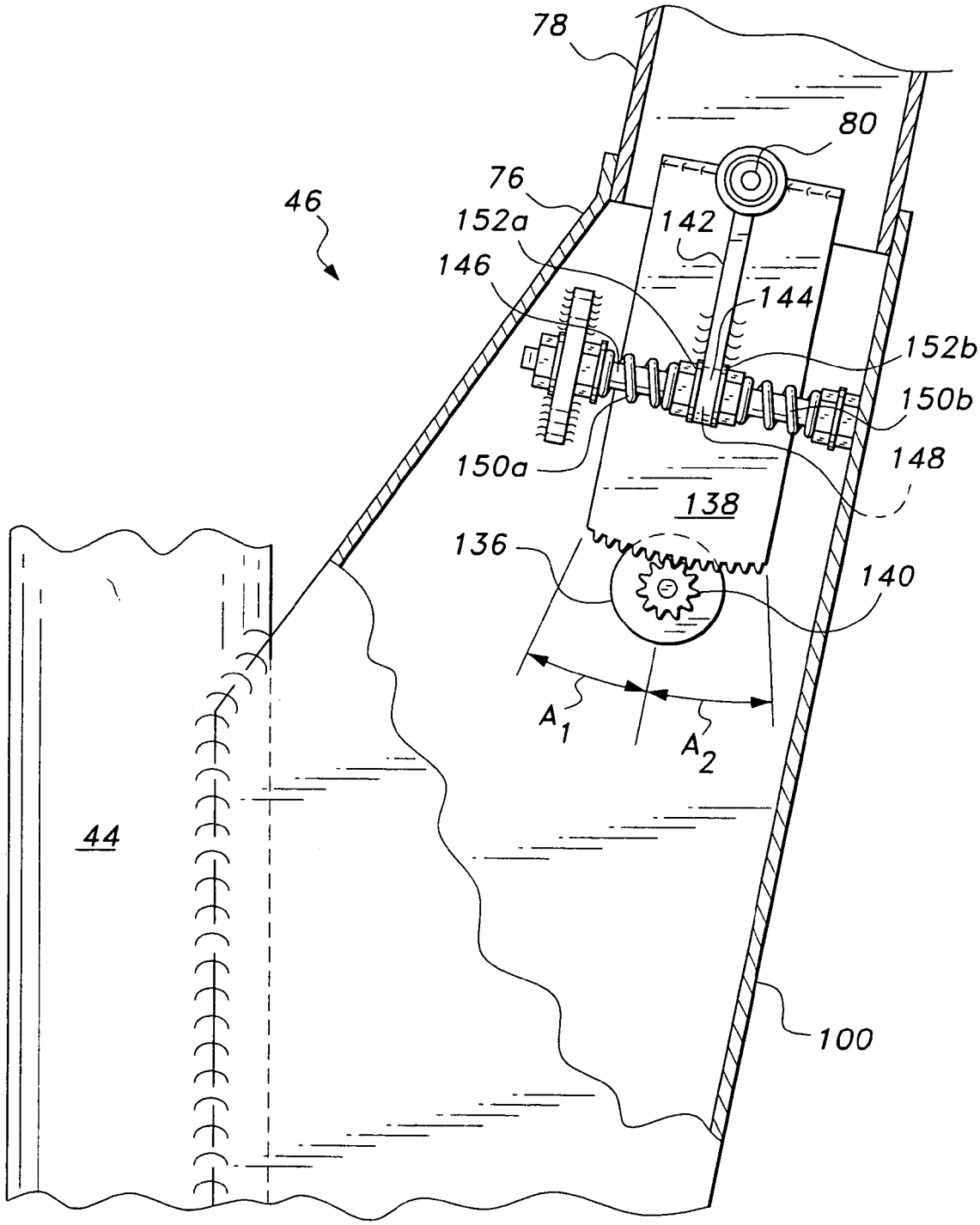
FIG. 7B is a side elevation view in section of the control handle of FIG. 7A, showing further details of the mechanism.

A means of controlling the speed of the machine over the surface is provided by the articulating upper handle extension 78, shown in FIGS. 1, 2, 4, 7A, and 7B. FIGS. 7A and 7B illustrate the mechanical arrangement of the components, with the electrical schematic of FIG. 8A illustrating the speed control rheostat 136 in the circuit. (A separate rheostat or fixed value resistor 137, shown in the electrical schematic of FIG. 8B, is used to control the operating speed of the wheel lifting and lowering actuator motor 94.) The handle extension 78 pivots forwardly and rearwardly on a pivot 80, as described further above. A sector gear 138 extends downwardly from the pivot, and swings back and forth with motion of the handle extension 78. The teeth of the sector gear 138 engage a pinion 140, which in turn rotates the internal rotating component of the rheostat 136. When the handle extension 78 is pulled rearwardly, the sector gear 138 swings forwardly, as indicated by the forward angle A1, which rotates the rheostat 136 counterclockwise (as shown in FIG. 7B) to decrease resistance to the circuit board 96 and increase the torque to the propulsion motor 58 driving the wheels 52*a*, 52*b*. This slows the machine 10 due to the reversal of torque to the wheels 52*a*, 52*b* to compensate for the pull of the sanding drum 14 as it engages the underlying surface. When the handle extension 78 is pushed forwardly, the sector gear 138 swings rearwardly to rotate the rheostat 136 clockwise (in FIG. 7B), thus reducing resistance and reducing the torque of the propulsion motor 58 to reduce its rearward pull and allow the sanding drum 14 to drag or pull the machine 10 more rapidly over the surface.

A centering mechanism, most clearly shown in FIG. 7B, is provided for the handle extension 78 in order to establish a neutral point for the rheostat 136 and resulting speed of the propulsion motor 58. A centering arm 142 is affixed (welded, etc.) to the sector gear plate 138, and terminates in a forked end 144 which fits over a stationary guide rod 146. The rod 146 includes a larger diameter stop 148 (shown in broken lines within the fork 144) at its center. Centering springs 150*a* and 150*b* extend along the guide rod 146, with stop washers 152*a*, 152*b* at their inboard ends. The springs 150*a*, 150*b* are prevented from extending beyond the center of the guide rod 146 by their stop washers 152*a*, 152*b* contacting the central stop 148, thus providing a positive centering force for the arm 142 and the sector gear 138.

Figure 10:
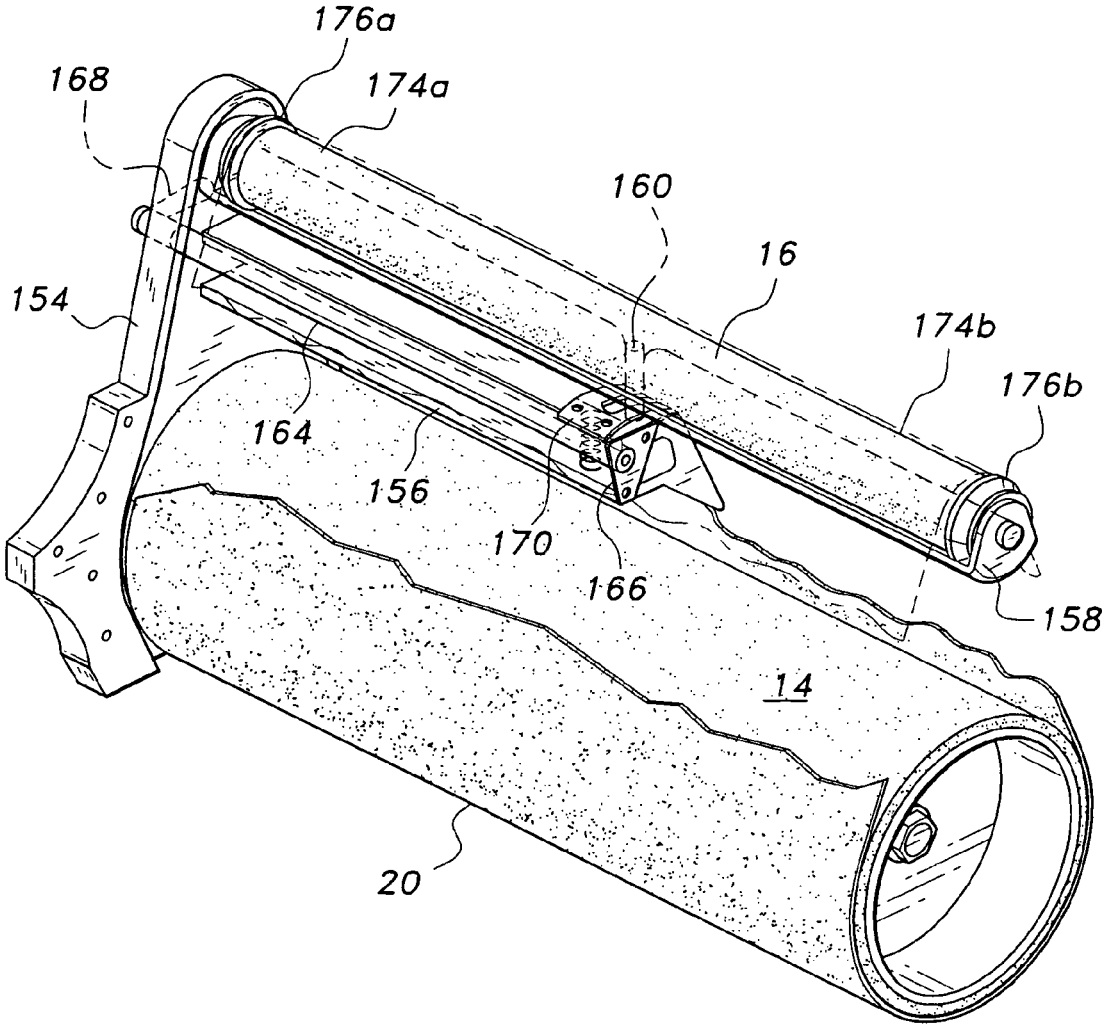
FIG. 10 is a detailed right rear perspective view in section of the sanding drum and its tensioner and lateral belt guide mechanism, showing details thereof.
Figure 11:
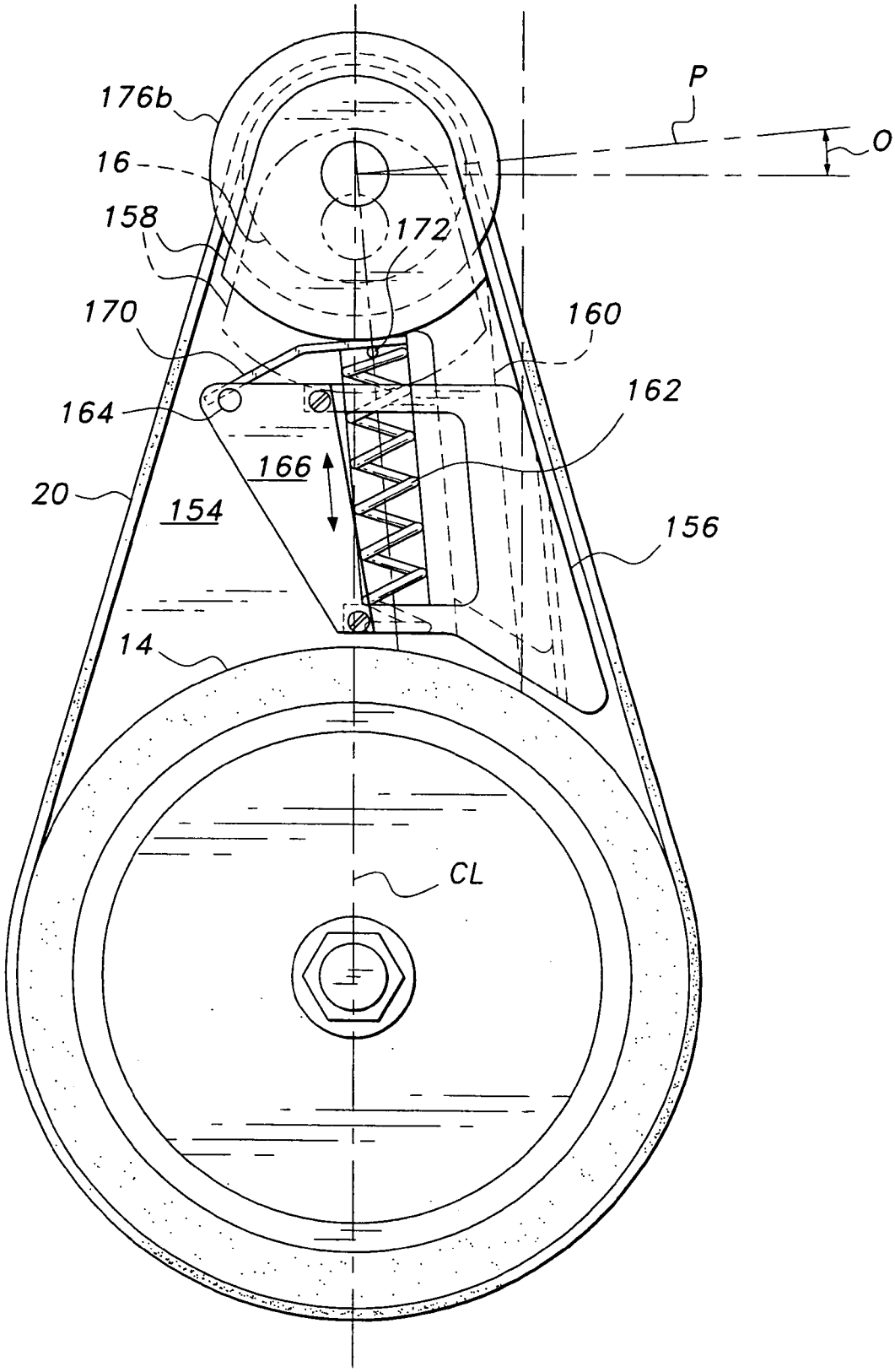
FIG. 11 is a right side elevation view in section of the sanding belt tensioner and lateral belt guide mechanism, showing further details of its mechanism and operation.
Figure 12:
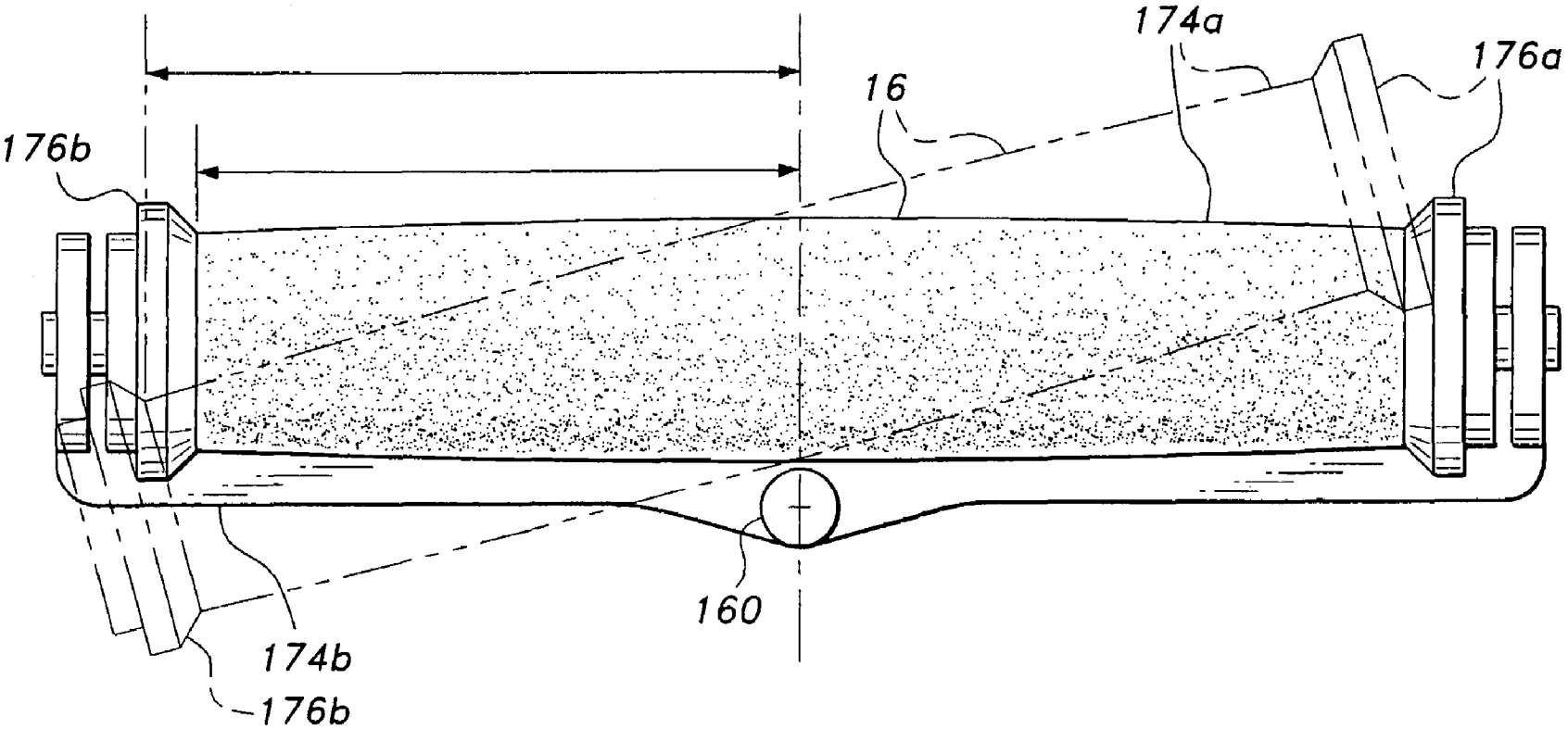
FIG. 12 is a top plan view of the sanding belt tensioner, showing its pivotal attachment about the angularly and forwardly offset pivot shaft.

The present automated floor sander machine 10 further includes a mechanism for automatically centering the sanding belt 20 upon the sanding drum 14 and tension roller 16, as shown in FIGS. 10 through 12. A rigid end support plate 154 extends upwardly from the left end of the drum 14 and chassis of the machine, with an elongate tension roller support strut 156 cantilevered rigidly from the support plate 154 adjacent and substantially parallel to the rotational axis of the sanding drum 14. The tension roller 16 is held in a cradle 158, which extends from the strut 156 on a pivot shaft 160 and laterally across the chassis. The sanding drum 14 and generally parallel tension roller 16 (depending upon the limited pivotal motion of the tension roller in accordance with the belt centering system, described further below) define a belt tension plane coincident with the centerline CL between the drum 14 and centered roller 16.

A spring 162 maintains pressure between the support strut 156 and the tension roller cradle 158. Belt tension may be released by means of a rotary shaft 164, which extends through the end support plate 154 and parallel to the support strut 156 to a shaft end support plate 166 extending from the inboard end of the support strut 156. A release handle 168 is provided on the outer end of the tension release shaft 164, with an actuating fork 170 extending from the shaft 164 and passing around each side of the spring 162 to bear on a transverse pin 172 above the tension roller cradle end of the spring 162. When the tension release shaft 164 is rotated clockwise in the view of FIG. 11 by means of its release handle 168, the fork 170 bears down on the pin 172 to compress the spring 162, thereby allowing the tension roller cradle 158 to slide toward the drum 14 along the pivot shaft 160 to release the tension on the sanding belt 20. The lowered position of the tension roller cradle 158 is shown in broken lines in FIG. 11.

It will be noted in FIG. 11 that the longitudinal axes of both the spring 162 and tension roller support strut 160 are angularly offset relative to the belt tension plane and centerline CL passing through the centers of rotation of the drum 14 and tension roller 16, when the roller 16 is at its maximum extension from the drum 14. The support strut 160 is also displaced forwardly of the belt tension plane and centerline CL, to define a caster offset and angle relative to the belt tension plane and centerline CL. Any laterally offset drag toward one end or the other of the tension roller 16 will result in the tension roller castering slightly about the pivot axis defined by the support strut 160.

This angular offset is identical to the offset angle O between the horizontal axis and the plane P of pivotal rotation of the tension roller 16 and its cradle 158, as shown in FIG. 11. This results in either end of the roller cradle 158 and its tension roller 16 pivoting forwardly and slightly upwardly, i.e. away from the drum 14 along the plane of pivotal rotation of the tension roller, when the tension roller 16 and its cradle 158 pivot away from precisely parallel alignment with the axis of the sanding drum 14. This is caused when the sanding belt 20 shifts or "walks" toward one end of the roller 16.

Each of the opposed ends 174*a*, 174*b* of the tension roller 16 has an end flange, respectively 176*a*, 176*b*, extending therefrom. These flanges 176*a*, 176*b* serve to retain the sanding belt 20 on the tension roller 16, and thus on the sanding drum 14. The top plan view of the tension roller 16 shown in FIG. 12 is used to provide an example of this operation, with the roller 16 being shown in solid lines in its neutral position and in broken lines with its right hand end 174*b* pivoted forwardly. (It will be understood that the pivotal displacement shown in broken lines in FIG. 12 is exaggerated for clarity in the drawing Fig.) When the belt 20 shifts or "walks" to the end 174*b* of the tension roller 16, the edge of the belt 20 contacts the corresponding tension roller flange 176*b*. When this occurs, the contact of the belt edge with that flange 176*b* pushes that end 174*b* of the tension roller 16 about its caster pivot shaft 160, causing that end of the tension roller to pivot forwardly. This results in a twisting of the sanding belt 20, which causes the belt to shift laterally from its offset position at the forwardly pivoted end of the tension roller 16 and back toward the center. The forwardly pivoted end of the tension roller 16, e.g. the second end 174*b* of the example shown in FIG. 12, also moves slightly upwardly due to the non-parallel axis of the pivot shaft 160 relative to the belt tension plane and centerline CL, i.e. away from the sanding drum 14. This also causes the sanding belt 20 to shift or "walk" back toward the opposite lower end of the tension roller 16. These two effects result in a continuing process during operation of the machine, with the belt 20 constantly and automatically correcting any minor misalignment errors. The roller 16 is also crowned slightly, i.e. having a slightly larger central diameter than at the ends, to provide further belt centering assistance.

It will be appreciated that the above described pivot or castering mechanism is but one of myriad mechanisms which may be used to cause the tension roller to caster or articulate as the sanding belt shifts laterally thereon, to cause the belt to shift back toward the center of the roller. For example, the roller could be cantilevered from the side plate of the chassis of the machine by a pair of parallel links, with their pivotal axes being angularly offset relative to the belt tension plane to cause the tension roller to shift slightly upwardly as it shifts forwardly due to sanding belt lateral movement on the roller. Another means of carrying out the belt centering function would be to provide a pair of non-parallel links to support the tension roller, with the projection of the links resulting in a virtual pivot point ahead of the tension roller about which the roller would seem to pivot. These mechanisms, as well as others, all result in the articulation of the roller as the belt shifts from a central position thereon, which further results in the roller shifting angularly relative to the sanding drum to cause the belt to walk back toward the center of the roller.

In conclusion, the present automated floor sanding machine provides numerous improvements over earlier devices of the related art. The mechanical and electronic means of raising and lowering the sanding drum by means of the drive wheels, greatly facilitates the operation of the machine. The speed control of the machine by the operator is also greatly facilitated by means of the articulated handle and its speed or torque control mechanism for the propulsion motor. The additional automated lifting and lowering of the drum by means of the drive wheels in accordance with the travel speed of the machine over the floor or other underlying surface, further facilitates use of the machine and assures that the operator cannot apply excessive sanding pressure to a single spot on the floor, thus assuring that the machine cannot sand or wear low spots in the floor. The forwardly and angularly offset pivotal axis of the tension roller further facilitates use of the device, as the sanding belt automatically remains centered on the tension roller, and thus on the sanding drum, at all times during operation. Yet, removal of the belt for replacement is easily accomplished by means of the pivotal release rod which releases tension on the tension roller.

The above noted features are particularly applicable to a "walk behind" type floor sander, as illustrated in the drawings for the present disclosure. However, it will be seen that the various inventive features may also be incorporated in other types of floor sanders, e.g. ride-on and ride behind type machines, as well. Also, it should be noted that while the present disclosure has described the machine as a floor sander, the various features described herein may be applied to virtually any machine operating on similar principles, e.g. drum type buffing and polishing machines, etc. It will also be seen that the various features of the present invention, with the exception of the automated belt centering mechanism, are adaptable to drum sanders wherein no tension roller is provided and the abrasive medium or sanding element extends circumferentially about the drum. Accordingly, the present automated machine will prove to be a most worthwhile piece of equipment to those engaged in the floor maintenance and other similar trades.

It is to be understood that the present invention is not limited to the embodiments described above, but encompasses any and all embodiments within the scope of the following claims.

I claim:

1. An automated floor sander, comprising:

a chassis;

a sanding drum disposed laterally across said chassis;

a sanding drum drive motor disposed with said chassis, selectively driving said sanding drum;

a sanding belt tension roller disposed laterally across said chassis;

an endless sanding belt disposed about said sanding drum and said tension roller;

an articulated support and drive axle and wheel assembly disposed laterally across said chassis;

a propulsion motor communicating mechanically with said support and drive axle and wheel assembly;

a support and drive wheel axle and wheel assembly height adjustment mechanism disposed with said chassis, selectively adjusting the height of said support and drive axle and wheel assembly;

an elongate handle extending from said chassis, said handle having a chassis attachment end and a distal operator control end opposite the chassis attachment end;

an operator controlled, electronic propulsion motor speed control mechanism disposed within said handle, communicating with said propulsion motor;

an automated, propulsion speed controlled, support and drive axle and wheel assembly lifting and lowering mechanism disposed with said chassis, and communicating electrically and mechanically with said support and drive axle and wheel assembly; and an automated sanding belt centering mechanism, supporting said tension roller.

2. The automated floor sander according to claim 1, further including:

an articulated handle extension, extending from the distal operator control end of said handle; and a speed control rheostat, communicating mechanically with said articulated handle extension and electronically with said propulsion motor.

3. The automated floor sander according to claim 1, further including a quick release sanding drum drive motor attachment mechanism disposed with said chassis and said sanding drum drive motor.

4. The automated floor sander according to claim 1, wherein said support and drive axle and wheel assembly further includes:

an axle and propulsion motor support arm, pivotally disposed within said chassis;

said propulsion motor and said support and drive axle and wheel assembly being rigidly secured to said axle and propulsion motor support arm, and articulating therewith; and said support and drive axle and wheel assembly lifting and lowering mechanism being connected to said axle and propulsion motor support arm.

5. An automated floor sander, comprising:

a chassis;

a sanding drum disposed laterally across said chassis;

a sanding drum drive motor disposed with said chassis, selectively driving said sanding drum;

an endless sanding belt disposed about said sanding drum;

an articulated support and drive axle and wheel assembly disposed laterally across said chassis;

a propulsion motor communicating mechanically with said support and drive axle and wheel assembly;

a support and drive wheel axle and wheel assembly height adjustment mechanism disposed with said chassis, selectively adjusting the height of said support and drive axle and wheel assembly;

an elongate handle extending from said chassis, said handle having a chassis attachment end and a distal operator control end opposite the chassis attachment end; and an operator controlled, electronic propulsion motor speed control mechanism disposed within said handle, communicating with said propulsion motor.

6. The automated floor sander according to claim 5, further including an automated, propulsion speed controlled, support and drive axle and wheel assembly lifting and lowering mechanism disposed with said chassis, and communicating electrically and mechanically with said support and drive axle and wheel assembly.

7. The automated floor sander according to claim 5, further including:

a sanding belt tension roller disposed laterally across said chassis; and an automated sanding belt centering mechanism, supporting said tension roller.

8. The automated floor sander according to claim 5, further including:

an articulated handle extension, extending from the distal operator control end of said handle; and a speed control rheostat, communicating mechanically with said articulated handle extension and electronically with said propulsion motor.

9. The automated floor sander according to claim 5, further including a quick release sanding drum drive motor attachment mechanism disposed with said chassis and said sanding drum drive motor.

10. The automated floor sander according to claim 5, wherein said support and drive axle and wheel assembly further includes:

an axle and propulsion motor support arm, pivotally disposed within said chassis;

said propulsion motor and said support and drive axle and wheel assembly being rigidly secured to said axle and propulsion motor support arm, and articulating therewith; and a support and drive axle and wheel assembly lifting and lowering mechanism connected to said axle and propulsion motor support arm.

11. An automated floor sander, comprising:

a chassis;

a sanding drum disposed laterally across said chassis;

a sanding drum drive motor disposed with said chassis, selectively driving said sanding drum;

a tension roller articulation mechanism disposed with said chassis;

a sanding belt tension roller extending from said tension roller articulation mechanism, said tension roller further including mutually opposed first and second ends, said tension roller and said sanding drum further defining a belt tension plane therebetween;

a first and a second flange disposed respectively upon the first and second ends of said sanding belt tension roller;

an endless sanding belt disposed about said sanding drum and said tension roller;

a support axle and wheel assembly disposed laterally across said chassis; and an elongated handle extending from said chassis, said handle having a chassis attachment end and a distal operator control end opposite the chassis attachment end; whereby said sanding belt is automatically cenered upon said tension roller due to contact with one said flange upon said tension roller and resulting articulation of said tension roller relative to said sanding drum.

12. The automated floor sander according to claim 11, further comprising:

an articulated support and drive wheel axle and wheel assembly height adjustment mechanism disposed with said chassis, selectively adjusting the height of said support and drive wheel assembly; and an operator controlled, electronic propulsion motor speed control mechanism disposed within said handle, communicating with said propulsion motor.

13. The automated floor sander according to claim 11, further including an automated, propulsion speed controlled, support and drive axle and wheel assembly lifting and lowering mechanism disposed with said chassis, and communicating electrically and mechanically with said support and drive axle and wheel assembly.

14. The automated floor sander according to claim 11, further including:

an articulated handle extension, extending from the distal operator control end of said handle; and a speed control rheostat, communicating mechanically with said articulated handle extension and electronically with said propulsion motor.

15. The automated floor sander according to claim 11, further including a quick release sanding drum drive motor attachment mechanism disposed with said chassis and said sanding drum drive motor.

16. The automated floor sander according to claim 11, wherein said support and drive axle and wheel assembly further includes:

a propulsion motor communicating mechanically with said support axel and wheel assembly;

an axle and propulsion motor support arm, pivotally disposed within said chassis;

said propulsion motor and said support and drive wheel assembly being rigidly secured to said axle and propulsion motor support arm, and articulating therewith; and a support and drive wheel assembly lifting and lowering mechanism connected to said axle and propulsion motor support arm.

* * * * *